US007356947B2

(12) United States Patent
Arzberger

(10) Patent No.: US 7,356,947 B2
(45) Date of Patent: Apr. 15, 2008

(54) METHOD FOR MAKING A TRENCH WALL IN THE GROUND, TRENCH WALL CUTTER, AND TRENCH WALL CUTTING DEVICE

(75) Inventor: Maximilian Arzberger, Igenhausen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 11/592,132

(22) Filed: Nov. 3, 2006

(65) Prior Publication Data

US 2007/0044347 A1 Mar. 1, 2007

Related U.S. Application Data

(63) Continuation of application No. 10/786,458, filed on Feb. 26, 2004, now Pat. No. 7,152,346.

(30) Foreign Application Priority Data

Feb. 27, 2003 (DE) ..... 103 08 538

(51) Int. Cl.
*E02F 1/00* (2006.01)
*E02F 3/08* (2006.01)
*E02F 3/24* (2006.01)

(52) U.S. Cl. ..... 37/189; 37/462; 37/195

(58) Field of Classification Search ..... 37/189, 37/190, 462, 463, 386, 387, 354, 195
See application file for complete search history.

(56) References Cited

U.S. PATENT DOCUMENTS

| | | | | |
|---|---|---|---|---|
| 3,603,099 | A | 9/1971 | Zakiewicz | |
| 4,694,915 | A | 9/1987 | Bauer et al. | |
| 4,696,607 | A | 9/1987 | Ressi di Cervia | |
| 4,785,559 | A | 11/1988 | Hentschel | |
| 4,930,940 | A | 6/1990 | Charlier et al. | |
| 5,411,353 | A | 5/1995 | Taki | |
| 5,924,222 | A * | 7/1999 | Stoetzer | 37/94 |

FOREIGN PATENT DOCUMENTS

| | | |
|---|---|---|
| DE | 1 902 138 | 8/1969 |
| DE | 1 634 262 | 9/1970 |
| DE | 34 24 99 | 1/1986 |
| DE | 36 12 020 | 10/1987 |
| DE | 88 12 636.6 | 3/1989 |
| DE | 39 05 463 | 8/1990 |

(Continued)

*Primary Examiner*—Christopher J. Novosad
(74) *Attorney, Agent, or Firm*—Jacobson Holman PLLC

(57) ABSTRACT

The invention relates to a method for making a trench wall in the ground, in which at least one cutting wheel located on a trench wall cutter is given a rotary movement by a drive, the trench wall cutter is lowered into the ground and soil material below the cutting wheel is stripped and a cut trench made, which is filled with a settable liquid. The stripped soil material is conveyed from the cutting wheel into a rear area of the cut trench, that the stripped soil material in the cut trench is intermixed with the settable liquid and that the stripped soil material is at least partly left in the cut trench for forming the trench wall. The invention also relates to a trench wall cutter and a trench wall cutting device.

21 Claims, 4 Drawing Sheets

FOREIGN PATENT DOCUMENTS

| | | |
|---|---|---|
| DE | 40 08 207 | 8/1990 |
| DE | 41 01 015 | 7/1992 |
| DE | 42 07 420 | 9/1992 |
| DE | 41 41 629 | 6/1993 |
| DE | 42 19 150 | 9/1993 |
| DE | 44 40 691 | 6/1996 |
| DE | 195 30 827 | 2/1997 |
| DE | 198 38 513 | 1/1999 |
| DE | 100 21 549 | 10/2001 |
| GB | 2253424 | 9/1992 |
| JP | 08 302670 | 11/1996 |
| JP | 09 273150 | 10/1997 |
| JP | 11 200404 | 7/1999 |
| JP | 2000 160592 | 6/2000 |
| WO | WO 86/01439 | 3/1986 |

* cited by examiner

METHOD FOR MAKING A TRENCH WALL IN THE GROUND, TRENCH WALL CUTTER, AND TRENCH WALL CUTTING DEVICE

CROSS-REFERENCE TO RELATED APPLICATIONS

This patent application is a continuation of application Ser. No. 10/786,458, filed Feb. 26, 2004 now U.S. Pat. No. 7,152,346, which is incorporated herein in its entirety.

BACKGROUND OF THE INVENTION

1. Field of the Invention

The invention relates to a method for making a trench wall in the ground, in which at least one cutting wheel located on a trench wall cutter is imparted a rotary movement by a drive, the trench wall cutter is lowered into the ground and soil material located below the cutting wheels is stripped and a cut trench made, which is then filled with a settable liquid.

The invention also relates to a trench wall cutter for making a cut trench. Such a trench wall cutter has a frame and at least one cutting wheel located on the frame.

The invention finally relates to a trench wall cutting device for making a trench wall, which is particularly suitable for performing the method and has a carrier implement and a trench wall cutter, which is essentially arranged in vertically adjustable manner on the carrier implement.

2. Related Art

A method for making a trench wall in the ground is known from DE 195 30 827 C2. In this so-called two-phase method, in a first phase a cut trench is excavated and the spoil from the cut trench is conveyed above ground. The resulting cut trench is filled with a support suspension and is in this way supported. In a second phase and following the sinking of the cut trench a hardening suspension is introduced into the trench, accompanied by the displacement of the support suspension.

In a one-phase method known from DE 41 41 629 C2, the trench is from the outset supported by a suspension, which is produced above ground by mixing excavated soil material and a binder.

For performing this known method it is possible to use trench wall cutters known from DE 34 24 999 C2. These known trench wall cutters have a cutting frame and cutting wheels drivable in a rotary manner and are fixed to the underside of said frame. The trench wall cutter is lowered on a cable from a construction vehicle and penetrates the ground as a result of its own weight.

The trench wall cutter is guided in the cut trench by means of the cutting frame, which is supported on the trench wall. Soil material stripped by the cutting wheels is supplied by the latter to a suction device fixed to the cutting frame and conveyed above ground.

However, for producing the binder-soil mixture, the above-described methods require comparatively complicated pumping, mixing and storage devices which are located above ground.

SUMMARY OF THE INVENTION

The object of the present invention is to provide a method for making a trench wall in the ground, a trench wall cutter and a trench wall cutting device, with which a trench wall can be made in a very simple manner.

The method according to the invention for making a trench wall in the ground is characterized in that the stripped soil material is conveyed from the cutting wheel into a rear area of the cut trench, that the stripped soil material is intermixed in the cut trench with the settable liquid and that the stripped soil material is at least partly left in the cut trench for forming the trench wall.

A fundamental idea of the invention is that soil material stripped by the cutting wheels is mixed in the cut trench as a result of the action of said cutting wheels with the settable liquid and this takes place so-to-speak in situ and in this way a hardening liquid-soil mixture is produced. There is no need to convey all the stripped soil material in a complicated manner above ground using pumping mechanisms. According to the invention, the stripped soil material is conveyed by the cutting wheels into a rear area of the cut trench. The rear area can be such that it is formed above the frame in the cut trench. According to the invention the stripped soil material intermixed with the liquid is at least partly left in the cut trench, where it can harden to form the trench wall. As a result of a possible volume change to the soil material during the supply of the settable liquid, it can however be advantageous to remove a part of the stripped soil material together with the suspension from the cut trench. For this purpose it is possible to provide a removal device on the trench wall cutter or above ground on the edge of the cut trench.

It is generally possible to uniformly drive at least one cutting wheel during the sinking of the cut trench. A particularly good cutting action and/or a particularly good intermixing of the soil material with the settable liquid can also be achieved in that the at least one cutting wheel is driven in a reversing manner. Through a temporary reversal of the rotation direction of the cutting wall turbulence arises in the soil material and brings about a particularly good mixing with the settable liquid. Preferably, the at least one cutting wheel is driven uniformly or in a reversing manner during the drawing of the trench wall cutter out of the cut trench, so that it is possible to significantly reduce the force expenditure necessary for the drawing operation and to bring about an additional thorough mixing of the stripped soil material with the settable liquid.

When making the cut trench, the trench wall cutter can be moved uniformly in the ground. However, it is particularly advantageous for the trench wall cutter, at least temporarily, to be given an alternating upward/downward movement. This leads to a particularly good intermixing of the removed soil material with the settable liquid. The stroke of this alternating upward/downward movement can be significantly less than the overall height of the trench. It can in particular be of the order of magnitude of the diameter of the cutting wheels. Such an at least temporarily performed alternating upward and downward movement can be brought about in that the trench wall cutter is raised by a construction implement and then lowered again. An alternating upward/downward movement can be performed both during the sinking of the cut trench and during the lifting of the trench wall cutter from the finished cut trench.

A trench wall cutter according to the invention is characterized in that the frame cross-section is smaller than the cut trench cross-section, accompanied by the formation of a free space, enabling stripped soil material to be conveyed past the at least one cutting wheel on the frame into a rear area of the cut trench.

A fundamental idea of the trench wall cutter according to the invention is to construct a free space in or alongside the frame through which stripped soil material and suspension can, during the making of the cut trench and/or on extracting the trench wall cutter from the finished cut trench, in an unhindered manner flow past the trench wall cutter frame. This brings about a particularly rapid and power-saving cutting with simultaneously an efficient mixing effect. According to the invention, for forming the free space, the frame cross-section never completely covers the cut trench perpendicular to the trench wall cutter advance direction. This can be achieved in that the circumferential dimensions of the frame cross-section are smaller than the internal dimensions of the cut trench and/or in that in the frame cross-section are provided one or more openings. Such an arrangement permits a flow-through of stripped soil material past the frame in a direction opposite to the frame movement direction.

In a particularly preferred trench wall cutter are provided several cutting wheels in a random number having parallel rotation axes. A preferred embodiment has four cutting wheels, wherein in each case two are arranged in pairs so as to rotate about the same rotation axis. A cross-section of the cut trench is preferably rectangular.

In an advantageous embodiment of the inventive trench wall cutter the at least one cutting wheel has a cutting tooth arrangement suitable for a reversing rotary movement. Such a cutting tooth arrangement can strip soil material both clockwise and counter clockwise during a rotation of the cutting wheels. This permits a particularly good intermixing of the soil material and at the same time a high working speed is obtained.

It is fundamentally possible to provide a supply device for supplying a liquid, particularly a settable liquid, at a random position within the cut trench. However, in a particularly preferred manner such a supply device is located on the frame. Particularly through an arrangement close to the at least one cutting wheel a particularly good intermixing of the stripped soil material and the liquid is achieved.

A trench wall cutting device according to the invention is characterized in that the trench wall cutter is displaceably guided on the carrier implement by means of a linear guidance mechanism.

According to one aspect of the trench wall cutting device according to the invention, the trench wall cutter is guided on a carrier implement spaced from said cutter and not on the cut trench wall. Guidance more particularly takes place in a direction parallel to the trench wall cutter advance direction. Such an arrangement makes it possible to keep the trench wall cutter frame cross-section as small as possible. In particular, it is no longer necessary for the trench wall cutter frame to be in contact with the cut trench wall for lateral guidance purposes. Thus, the frame can be designed without guide members and its dimensions can be kept correspondingly small, which permits a simple passage of stripped soil material. The trench wall cutter can e.g. be used on a guide mechanism, such as is known in connection with vibrators.

In a particularly preferred trench wall cutting device, the linear guidance mechanism has a guide rod, particularly a telescopic rod, on which is mounted the trench wall cutter. Such a guide rod permits a particularly good lateral guidance of the trench wall cutter. It more particularly allows a transfer of an axial force directed in the advance direction from the carrier implement to the trench wall cutter, which makes it possible to obtain a particularly rapid advance of said cutter during sinking. However, the trench wall cutter can also be constructed in such a way that in the case of rotary cutting wheels it cuts into the ground merely as a result of its own weight. It is also possible in this case to use a guide rod, which is not designed for the transfer of the axial force directed in the advance direction.

The guide rod diameter is preferably dimensioned in such a way that it is smaller than the diameter of the frame cross-section. The guide rod preferably has a substantially rectangular or a substantially circular cross-section. A Kelly rod is preferably used as the telescopic rod.

A particularly preferred trench wall cutting device is also characterized in that the linear guidance mechanism has a guide sleeve located on the carrier implement and through which is passed the guide rod. Such a guide sleeve can circumferentially wholly or only partly embrace the guide rod. On the guide sleeve can be formed projections and/or depressions, which engage with corresponding depressions and/or projections on the guide rod and therefore ensure a connected to rotate guidance of the guide rod.

It is particularly advantageous to have on the carrier implement a servomechanism, particularly a cable-hauled mechanism, for the vertical displacement of the guide rod. Besides the extraction of the trench wall cutter from the cut trench, such a servomechanism can also be designed to transfer an axial force in the trench wall cutter advance direction to said cutter. This ensures a particularly good cutting efficiency. The servomechanism can also be designed in such a way as to permit an alternating upward/downward trench wall cutter movement. Possible embodiments of the servomechanism have a rack mechanism or a hydraulic mechanism.

Advantageously the trench wall cutting device according to the invention has the above-described trench wall cutter. The method according to the invention can in particular be implemented with said two means.

BRIEF DESCRIPTION OF THE DRAWINGS

The invention is described in greater detail hereinafter relative to preferred embodiments and the attached diagrammatic drawings, wherein show.

DETAILED DESCRIPTION OF THE PREFERRED EMBODIMENTS

Figure 1:
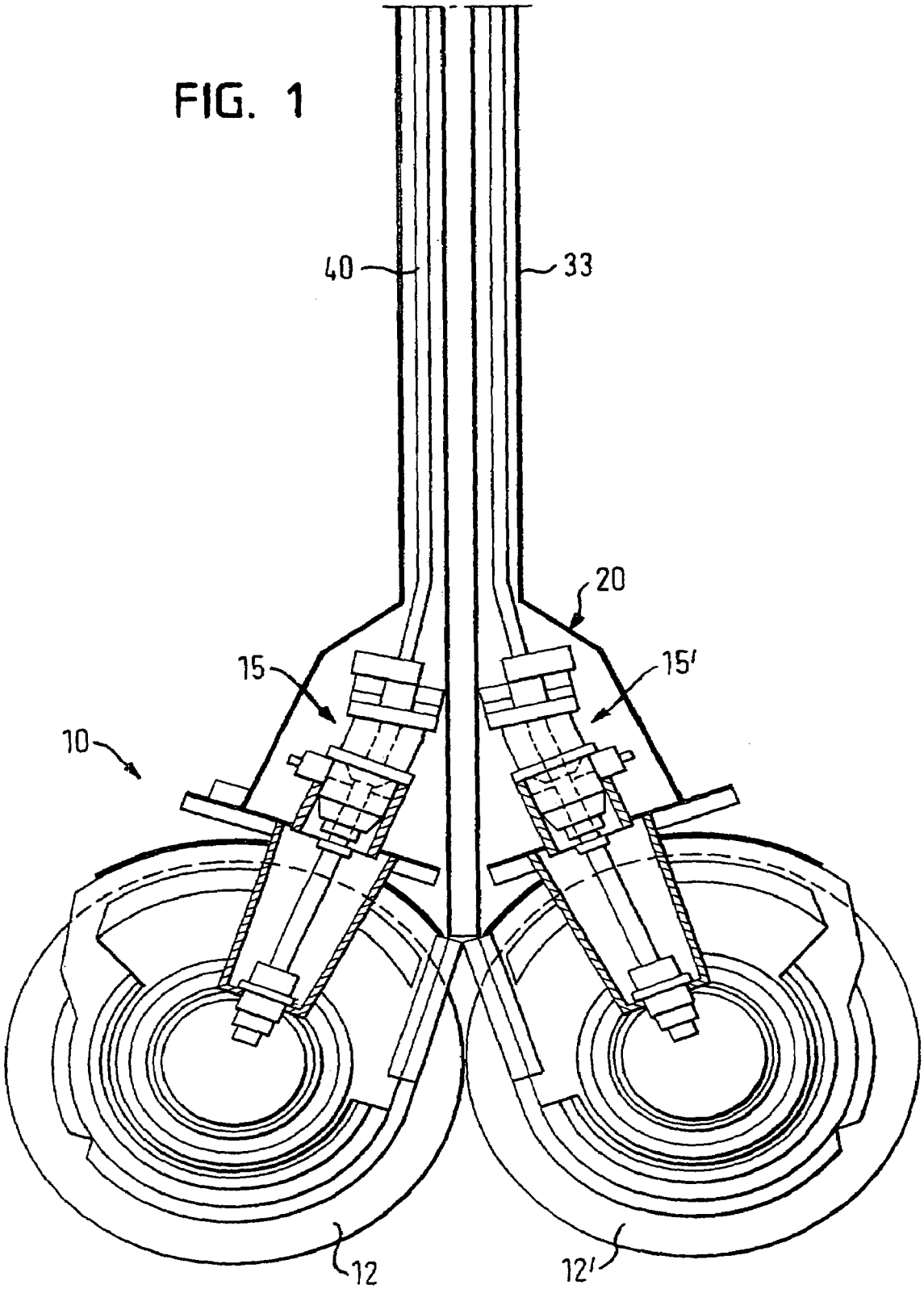
FIG. 1 A part sectional front view of an inventive trench wall cutter and a guide rod.
Figure 2:
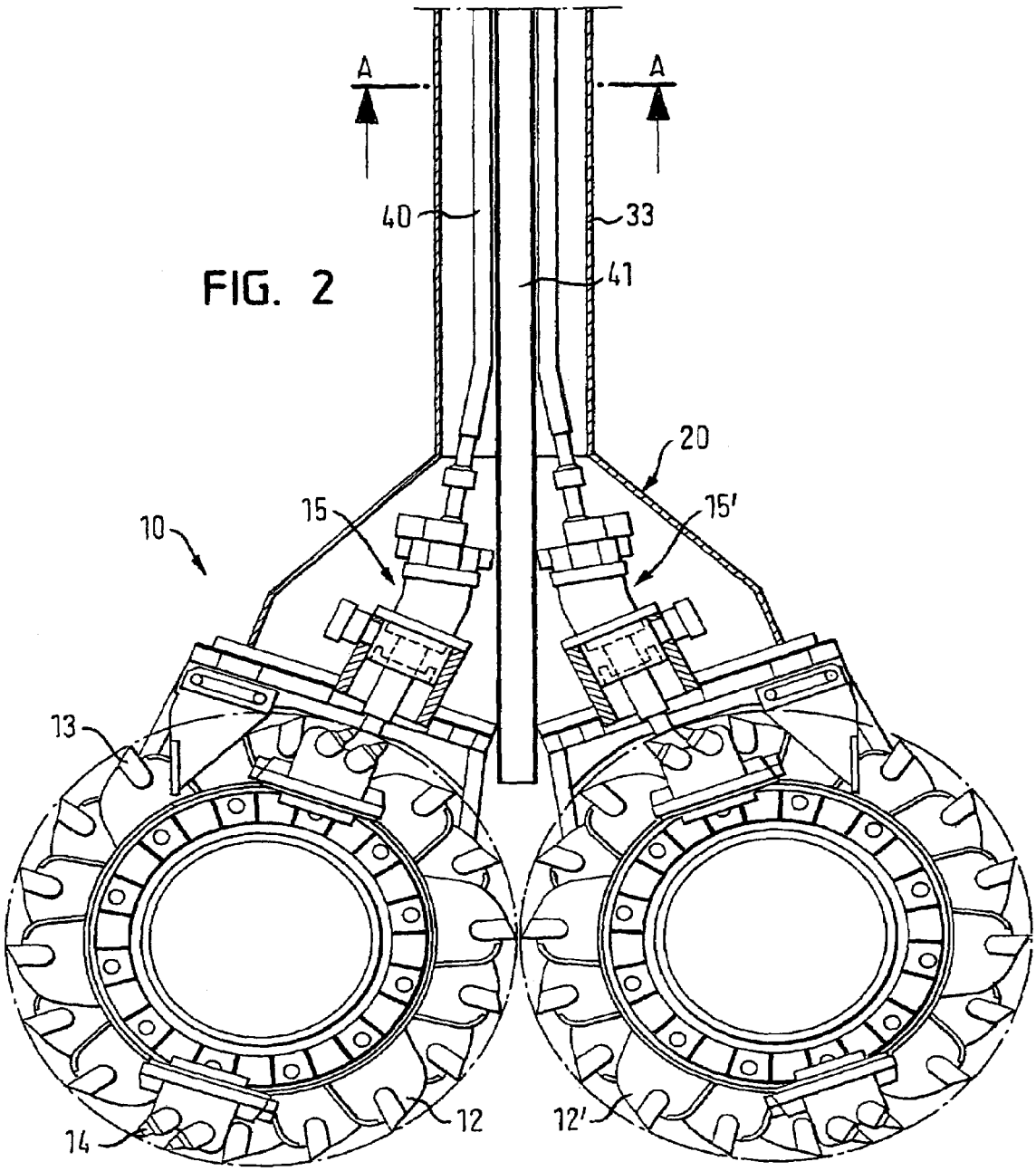
FIG. 2 A part sectional front view of a further inventive trench wall cutter with a guide rod.
Figure 4:
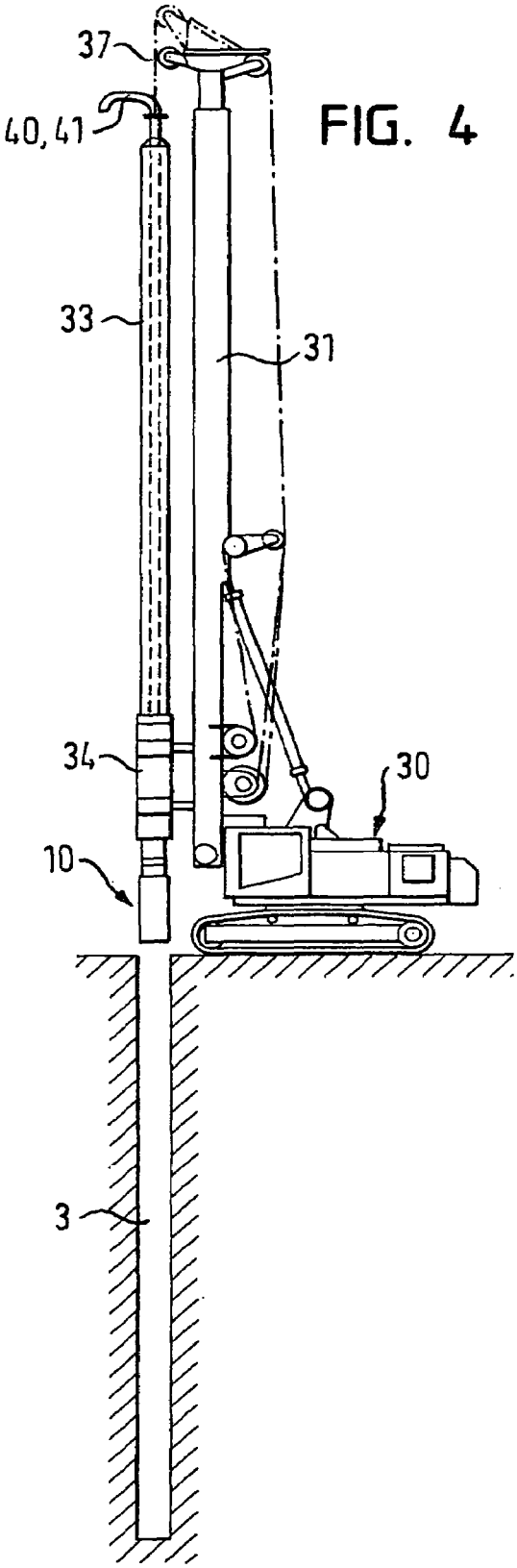
FIG. 4 A side view of an inventive trench wall cutting device.
Figure 5:
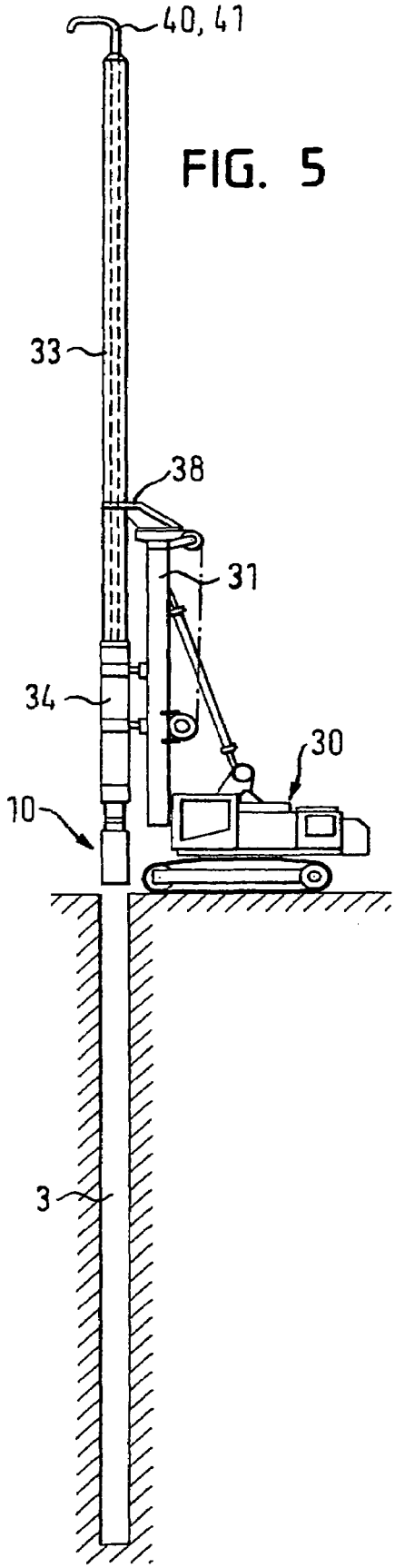
FIG. 5 A side view of a further inventive trench wall cutting device.
Figure 7:
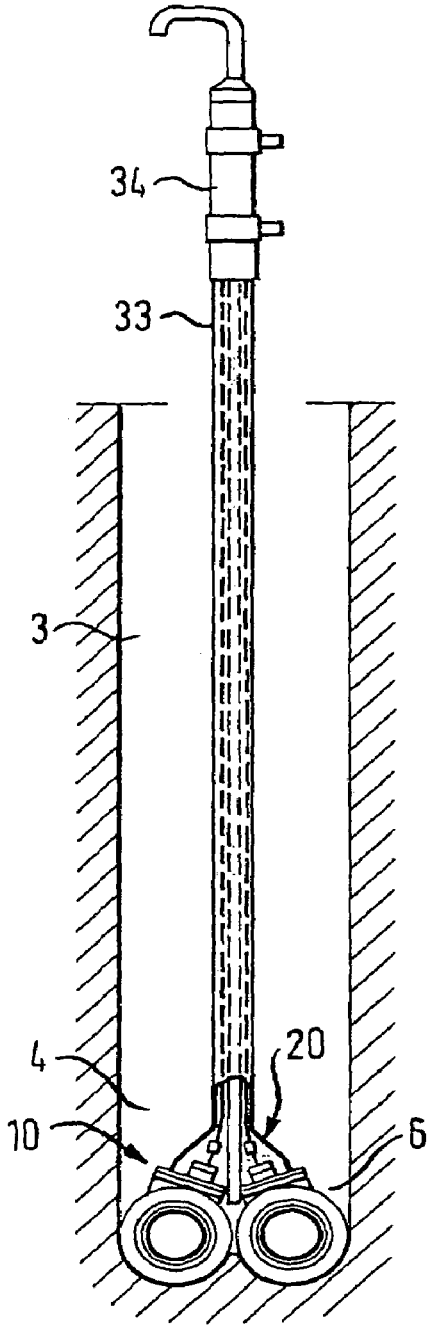
FIG. 7 A partial view of an inventive trench wall cutting device in an end position.
Figure 6:
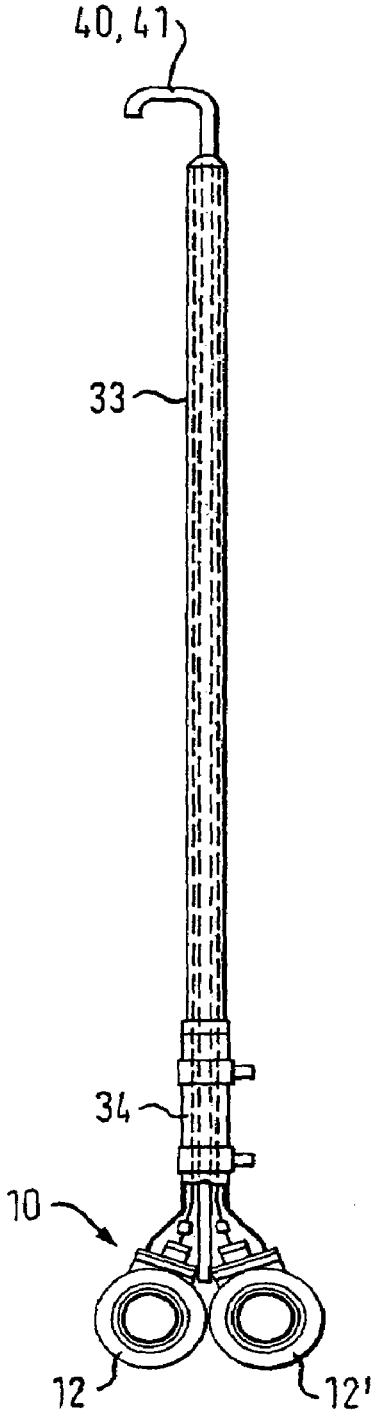
FIG. 6 A partial view of an inventive trench wall cutting device in the raised state.

FIGS. 1 and 2 are front views of two different embodiments of trench wall cutters 10 according to the invention. Two cutting wheels 12, 12' are fixed in rotary manner to a frame 20 in the form of a carrier plate. The cutting wheels 12, 12' are constructed in a directly juxtaposed manner with parallel rotation axes. A housed drive 15, 15' constructed in hydraulic motor form is fitted to the frame 20 and operatively connected to the cutting wheels 12, 12'.

Figure 3:
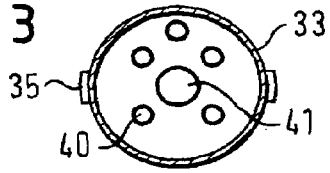
FIG. 3 A cross-sectional view of the guide rod shown in FIG. 2 along A-A.

On the sides of the frame 20 remote from the cutting wheels 12, 12' is fixed a guide rod 33. As can be gathered from FIG. 3, the guide rod 33 has an approximately circular cross-section. Projections 35 are constructed laterally on the guide rod 33 and are used for connected to rotate guidance of the guide rod 33 in the guide sleeve 34. Hydraulic fluid supply lines 40 are located within the guide rod 33. A liquid supply device 41 in the form of a supply line is also located in the guide rod 33 and on frame 20. As shown in FIG. 2, the supply device 41 constructed as a supply line passes through the frame 20 and terminates between the cutting wheels 12, 12'.

Circumferentially cutting teeth 13 are formed on the cutting wheels 12, 12'. The cutting teeth 13 are arranged for a contrarotating operation of the cutting wheels. The cutting wheel 12 to the left in FIG. 2 rotates clockwise, whereas the cutting wheel 12' located to the right rotates counter clockwise. Thus, in the central area the suspension is subject to suction action by the cutting wheels 12, 12', whilst the cut soil material, together with the suspension, is conveyed upwards on the outsides. On the cutting wheels 12, 12' are also circumferentially arranged known, lateral, pivotable hinged teeth 14, which strip soil below the gear shield.

FIGS. 4 to 7 show a trench wall cutting device according to the invention. The trench wall cutting device has a carrier implement 30 constructed as a crawler-operated construction vehicle. On the carrier implement 30 is installed a mast 31, where a guide sleeve 34 is fixed to two fixing points. The guide rod 33, to whose lower end is fixed the trench wall cutter 10, passes vertically through the guide sleeve 34. A cable-hauled mechanism 37 (FIG. 4) or a sliding device 38 (FIG. 5) are provided for the vertical displacement of the guide rod 33. Hydraulic fluid supply lines 40 and a supply device 41 constructed as a supply line for a settable liquid pass out of the guide rod 33 at the upper end thereof. In the raised state of the trench wall cutter 10 (FIG. 6), the frame of the latter engages directly on the guide sleeve 34.

The frame 20 of the trench wall cutter 10 is constructed in such a way that during sinking (FIG. 7) a free space 6 is formed between the frame 20 and one wall of the cut trench 3. This free space 6 allows the passage of stripped soil material past the frame 20 into a rear area 4 of the cut trench 3, which is located above the trench wall cutter 10.

What is claimed is:

1. Trench wall cutting device for making a trench wall, comprising:

a carrier implement, a trench wall cutter for making a cut trench, the trench wall cutter being located in a substantially vertically displaceable manner on the carrier implement and including:

a frame having a cross-section smaller than the cross-section of the cut trench, and at least one cutting means located on the frame for stripping soil material, and linear guidance means for displaceably guiding the trench wall cutter on the carrier implement and for transferring, from the carrier implement to the trench wall cutter, an axial force directed from the carrier implement to the trench wall cutter.

2. Trench wall cutting device according to claim 1, wherein the linear guidance means has a guide rod, on which is mounted the trench wall cutter.

3. Trench wall cutting device according to claim 2, wherein the linear guidance means has a guide sleeve located on the carrier implement and through which is passed the guide rod.

4. Trench wall cutting device according to claim 3, wherein the guide sleeve has formed thereon at least one of projections and depressions, wherein the guide rod has formed thereon at least one of projections and depressions corresponding to the projections and depressions formed on the guide sleeve, and wherein the projections and depressions of the guide sleeve engage corresponding depressions and projections of the guide rod.

5. Trench wall cutting device according to claim 2, wherein the guide rod is telescopic.

6. Trench wall cutting device according to claim 2, wherein the frame tapers in a direction from the at least one cutting means to the guide rod.

7. Trench wall cutting device according to claim 2, wherein the guide rod and the frame cross-section both have a diameter, and the guide rod has a diameter smaller than the diameter of the frame cross-section.

8. Trench wall cutting device according to claim 1, wherein on the carrier implement is provided a servomechanism for the vertical displacement of a guide rod.

9. Trench wall cutting device according to claim 8, wherein the servomechanism is a cable-hauled mechanism.

10. Trench wall cutting device according to claim 8, wherein the servomechanism is suitable for transferring an axial force in a trench wall cutter advance direction from the carrier implement to the trench wall cutter.

11. Trench wall cutting device according to claim 1, wherein the carrier implement is a construction vehicle.

12. Trench wall cutting device according to claim 1, further comprising removal means provided on the frame for removing soil material stripped by the at least one cutting means.

13. Trench wall cutting device according to claim 1, wherein the at least one cutting means is a cutting wheel.

14. Trench wall cutting device according to claim 1, wherein the at least one cutting means comprise four cutting wheels provided on the frame, wherein in each case two cutting wheels are arranged in pairs so as to rotate about the same rotation axis.

15. Trench wall cutting device according to claim 1, wherein the trench wall cutter further comprises supply means located on the frame for supplying a settable liquid into the cut trench at the frame.

16. Trench wall cutting device according to claim 1, wherein the trench wall cutter makes a cut trench accompanied by the formation of a free space, and wherein the at least one cutting means further functions to convey soil material stripped through the free space past the frame into a rear area of the cut trench and to intermix the soil material and the liquid together in the cut trench, the rear area being formed above the frame in the cut trench.

17. Trench wall cutting device according to claim 1, wherein the trench wall cutter makes a cut trench accompanied by the formation of a free space.

18. Method for making a trench wall in the ground using the trench wall cutting device according to claim 1, comprising the steps of imparting a rotary movement to the at least one cutting means using a drive, lowering the trench wall cutter with the frame into the ground and stripping soil material located below the at least one cutting means and making a cut trench filling the cut trench with a settable liquid at the frame, conveying the stripped soil material from the at least one cutting means into a rear area of the cut trench, intermixing the stripped soil material with the settable liquid in the cut trench and leaving the stripped soil material intermixed with the settable liquid at least partly left in the cut trench for forming the trench wall.

19. Method for making a trench wall according to claim 18, wherein at least one cutting means is driven in reversing manner.

20. Method for making a trench wall according to claim 18, wherein when making the cut trench, the trench wall cutter is at least temporarily given an alternating upward/downward movement.

21. Trench wall cutting device according to claim 1, wherein the linear guidance means includes a guide rod, and wherein the guide rod has at least one of a rectangular and a circular cross-section.

* * * * *